United States Patent [19]

Evani et al.

[11] 4,242,408

[45] Dec. 30, 1980

[54] EASILY DISPOSABLE NON-WOVEN PRODUCTS HAVING HIGH WET STRENGTH AT ACID PH AND LOW WET STRENGTH AT BASE PH

[75] Inventors: Syamalarao Evani; William A. Foster, both of Midland, Mich.

[73] Assignee: The Dow Chemical Company, Midland, Mich.

[21] Appl. No.: 52,053

[22] Filed: Jun. 25, 1979

Related U.S. Application Data

[63] Continuation-in-part of Ser. No. 820,952, Aug. 1, 1977, abandoned.

[51] Int. Cl.[3] ..... A61F 13/18; A61F 13/20; B32B 25/02

[52] U.S. Cl. ..... 428/290; 128/113; 128/290 P; 427/337; 427/342; 427/382; 427/389; 427/391; 427/392; 427/393; 428/475.8; 428/476.3; 428/483; 428/507; 428/511; 428/514; 428/520; 428/913

[58] Field of Search ..... 428/290, 507, 511, 514, 428/913, 475.8, 476.3, 483, 520; 427/337, 342, 382, 389, 391, 392, 393; 128/113, 290 P

[56] References Cited

U.S. PATENT DOCUMENTS

| | | | |
|---|---|---|---|
| 4,035,540 | 7/1977 | Gander | 428/198 |
| 4,117,187 | 9/1978 | Adams | 428/913 |

*Primary Examiner*—James C. Cannon

[57] ABSTRACT

A non-woven flexible web having enhanced wet strength and easy disposability is prepared by adhering the fibrous elements of the web with a polymer of an unsaturated acid and an unsaturated water-insoluble monomer in a ratio wherein the polymer is insoluble at lower pH values and soluble at higher pH values.

9 Claims, No Drawings

EASILY DISPOSABLE NON-WOVEN PRODUCTS HAVING HIGH WET STRENGTH AT ACID PH AND LOW WET STRENGTH AT BASE PH

CROSS-REFERENCE TO COPENDING APPLICATION

This application is a continuation-in-part of our copending application, U.S. Ser. No. 820,952, filed Aug. 1, 1977 now abandoned.

BACKGROUND OF THE INVENTION

Premoistened tissues are available for a variety of purposes. Exemplary of such products is a package of moistened tissues containing a cleansing agent. Those tissues find use for cleaning hands when one is away from usual lavatory facilities as, for example, with travelers.

Other such tissues are premoistened for general cleaning usage and may or may not contain additives for special functions.

Any such product must have sufficient wet strength to remain substantially intact during the rubbing and cleaning actions. Following use it would be desirable if it would be easily disintegrated to be disposable in conventional sanitary facilities.

The prior known premoistened tissues have had adequate wet strength but presented a disposal problem usually requiring disposal as solid waste in litter bags, waste receptacles and the like.

THE PRIOR ART

U.S. Pat. No. 4,117,187 describes premoistened wipes of a non-woven material bonded together with an alkali-soluble polymer, a wetting liquid and alkali metal ions throughout the web.

U.S. Pat. No. 3,171,773 teaches a product of a non-woven fabric of flattened, hollow fibers of regenerated cellulose which is fully flushable.

U.S. Pat. No. 3,370,590 utilizes those flattened, hollow fibers with certain water-soluble polymers to result in a product which is disintegratable in a large volume of turbulent water such as is found in flushing a tiolet.

U.S. Pat. No. 3,784,488 describes pH sensitive polymers which are alkali soluble but water insoluble. The polymers are useful in preparing formulations such as suntan lotions.

Alkali-soluble latexes are known as described, for example, in Canadian Pat. No. 813,959.

DESCRIPTION OF THE INVENTION

This invention is directed to a non-woven web having enhanced wet strength and easy disposability wherein the individual fibers of said mat are adhered to each other by a pH sensitive binder such that the web has adequate wet strength properties to exposure in an environment at a lower pH value but readily disintegrate in an environment at a higher pH for ready disposal in flushable facilities.

The binder is generally disposed between the fibers at their points of contact leaving the portion of the fiber between such contacts substantially untreated. In this way, the fibers will be capable of use of the fiber properties, as for example, water absorbency, for which the web was prepared. In contrast, fibers which are substantially coated (i.e., sized) would tend to defeat the purpose of the invention.

The fibers may be any of those commonly employed in making non-woven webs. Preferred fibers, are the cellulosic fibers of cotton and wood. Also, useful are hair, silk, wool and other natural animal and plant fibers. Likewise, synthetic fibers such as polyamides, polyesters, acrylics and other fibers used in the textile industry find use herein.

Paper in its various untreated or uncoated varieties is especially useful herein and is the preferred species of flexible web.

The useful polymers are those interpolymers of at least one ethylenically unsaturated carboxylic acid and at least one ethylenically unsaturated water-insoluble monomer.

The carboxylic acid serves to render the resulting polymer soluble at higher pH's. Representative of such acids are acrylic acid, methacrylic acid, itaconic acid, crotonic acid, as well as other mono- and dicarboxylic acids or anhydrides or partial esters thereof which will be polymerizable with the particular water-insoluble monomer being employed.

The water-insoluble monomer is chosen from a wide variety of such compounds. In addition to insolubilizing the polymer, this monomer can be employed to adjust the properties of the polymer. Included among such monomers are styrene and the nuclear substituted styrene, the alkyl acrylate and methacrylate esters, such as butyl acrylate, octyl acrylate, lauryl acrylate and the corresponding methacrylate esters. Also included are the olefins, such as ethylene, propylene and butadiene. Other such monomers are the vinyl alkanoates, such as vinyl acetate and vinyl propionate. The vinyl and vinylidene halides, such as vinyl chloride and vinylidene chloride are also useful. Any water-insoluble ethylenically unsaturated monomer copolymerizable with the acidic monomer including mixtures of such monomers will be useful herein. Judicious selection of such monomers can be made by simple preliminary experiments.

The ratio of acidic monomer to hydrophobic monomer will vary depending on the particular choice of those monomers and will determine the hydrophilic/hydrophobic balance of the polymer. Sufficient acidic monomer must be used to impart the pH reversible solubility and insolubility to the polymer. For example, with a copolymer of vinyl acetate and methacrylic acid, some alkali solubility is shown even at 10 mole percent acid; with an alkyl acrylate/acrylic acid copolymer, the acid should be present in from about 10 to about 15 mole percent acid, with styrene/maleic anhydride copolymers there should be from 15 to 20 mole percent acid; and with tertiary butyl styrene/maleic anhydride, at least 33 mole percent acid is needed. Ratios with other monomer blends will be easily determined with generally from 5 to about 30 mole percent being optimum.

A particularly useful class of polymers are the terpolymers of a hydrophobic monomer, such as styrene, a copolymerizable ethylenically unsaturated carboxylic acid monomer or dicarboxylic anhydride, such as maleic anhydride and an alkenyl benzyl ether of an alkyl capped polyoxyethylene moiety wherein the polyoxyethylene group contains at least about 10 units. Such polymers are described in a number of patents including U.S. Pat. Nos. 4,151,341; 3,794,608; 4,008,202 and 4,025,484.

The molecular weight of the polymers will likewise vary with the choice of monomers and the desired strength of the web. Very low molecular weight polymers, as, for example, oligomers, will generally not provide sufficiently high strength for most end uses. Very high molecular weight polymers are not practical for commercial utilization because, for example, their high viscosity solutions are difficult to apply to the web.

The polymers are readily prepared by conventional addition polymerization techniques including the usual reaction parameters of time, temperature, pressure, order of addition and other conditions known in the art. When the polymer is to be deposited in the fiber matrix from solution, the polymer may be prepared in solution, suspension, emulsion or mass and after isolation, redissolved in the solvent of choice or may be prepared directly in the solvent and used without isolation. When the polymer is to be deposited from a dispersion, it will usually be emulsion polymerized and diluted if necessary.

In some instances, it may be desirable to add conventional additives such as light and heat stabilizers, dyes and pigments, plasticizers and like materials for their stated effect.

In preparing the treated webs, the polymer solution or dispersion is deposited within the flexible web. To achieve uniformity of distribution of the polymer throughout the web, the fibers must not be tightly matted or packed together, since that could foreclose passage of the polymer between some or all of the fibers. Most conveniently, the fibrous elements of the web are swollen with water prior to deposition of the polymer.

The polymer, when deposited from solution, will usually be in the salt form. To achieve the water-insoluble state, the polymer will have to be converted to the acid form. That will usually be accomplished by contacting the impregnated web with acid. When the salt form is the ammonium salt, most of the ammonia can be driven off following impregnation. Since the level of acidity required to form the acid state of the polymer is dependent on the degree of alkalinity in the web, the use of the ammonium salt requires considerably less acid to convert the polymer to that acid state. For example, when the sodium salt of the polymer is used, it will require a very strong acid treatment of a pH of 1 to 2 to generate the acid polymer. With the ammonium salt, the treatment can be at a pH of 2.5 to 3.

It is apparent that the amount of pH adjustment required to attain the acid form of the polymer is a function of the degree of alkalinity in that polymer as applied to the web. When excess alkaline agent is employed in making the treating solution, the wet strength properties of the product will suffer. Accordingly, it is preferred to neutralize the polymer only to the minimum extent needed to achieve water solubility.

The acid conversion can be accomplished by contacting the polymer impregnated web with an acid such as acetic acid, either by use of an aqueous acidic solution or by passing the treated web through vapors of the acid.

When the polymer is deposited in the web from a latex or other dispersion, the polymer may be in the acid form in the dispersion or may be converted into that form by the previously mentioned techniques. Preferably, however, the polymer will be in the salt form.

The amount of polymeric binder required in the web will vary with the type of fiber, the anticipated end use, the nature of the polymer and other factors. Generally, a minimum of about 1.5 weight percent polymer based on the weight of fibers will suffice to provide adequate properties for most uses. The use of more than about 5 weight percent will usually not provide commensurate advantages and will only increase the cost of the product and may stiffen its hand.

The invention will be more apparent from the following non-limiting examples wherein all parts and percentages are by weight. Three different polymers are employed in the examples as follows.

A copolymer of styrene and maleic anhydride containing 48 weight percent of the latter was prepared. The copolymer had a viscosity of 4 centipoises. This copolymer is referred to as Polymer A.

A second interpolymer was prepared from 48.75 percent styrene, 50 percent maleic anhydride and 1.25 percent of a vinylbenzyl ether of a 40 mole ethylene oxide adduct of nonyl phenol. The disodium salt of the polymer was prepared at pH 7. This copolymer is referred to as Polymer B.

A third interpolymer was prepared by making the diammonium salt of the base polymer used in making Polymer B. This polymeric diammonium salt is referred to as Polymer C.

EXAMPLE 1

A crepe paper sold as M-1979 by American Can Company was swollen with water and dipped into a solution of the binder. The paper was pressed between paper towels and dried at 75° C. in a forced air oven. The samples contained 5 percent binder. Part of the paper samples were dipped in 2.5 percent aqueous phosphoric acid for one minute, rinsed in distilled water and stored in water at pH 1 to 2.

The remainder of the paper samples was dipped in 1.25 percent aqueous phosphoric acid, rinsed in distilled water and stored in water at pH 2 to 3.

One set of water swollen paper samples was left untreated as a blank.

The wet tensile strength of the samples was determined and the results reported in Table I. Each value in the table represents an average of six test samples. Also in the table the superscript "a" represents the 2.5 percent acid sequence and the superscript "b" represents the 1.25 percent acid sequence.

TABLE I

| Binder | Tensile Strength gm/inch |
|---|---|
| Blank | 192 |
| A | 3651[a] |
| A | 2858[b] |
| B | 2903[a] |
| C | 2227[a] |
| C | 1747[b] |

EXAMPLE 2

This example illustrates the effect of percent binder level on wet tensile strength at storage pH values of 2 and 5.

The crepe paper of Example 1 was saturated with the respective aqueous polymer solutions at required concentrations and squeezed between paper towels or wringer rolls so as to give about 100 percent by weight wet pickup. The wet paper was then dried on a drum drier at 220° F. for five minutes. The dried paper was cut into 1"×4" strips (creped wrinkles ran with the longer dimension). Six strips of each sample were stapled together, dipped for 30 seconds in a one percent phosphoric acid so as to cause in situ conversion of the applied polymer to the water-insoluble, less-ionized carboxylic form, and then rinsed in a large amount of distilled water for one minute.

The wet strips were then stored in deionized water preadjusted to different pH values using phosphoric acid. The wet strips were tested for tensile strength after 18 hours of soaking.

The results are shown in Table II.

TABLE II

| Polymer | % Polymer on Paper | Wet Tensile Strength at pH 2 | Wet Tensile Strength at pH 5 |
|---|---|---|---|
| — | 0 | 192 | 192 |
| A | 1.25 | 850 | 800 |
| | 2.5 | 1450 | 1400 |
| B | 1.25 | 525 | 450 |
| | 2.5 | 850 | 650 |
| | 5.0 | 1050 | 850 |
| C | 1.25 | 525 | 400 |
| | 2.5 | 900 | 700 |
| | 5.0 | 1500 | 1300 |

EXAMPLE 3

Tests were conducted to determine the effect on the wet tensile strength of the amount of neutralizing agent employed in the solution from which the polymer was applied.

When Polymer B was applied from a solution at pH 5.9, it required 1.6–1.7 percent binder to achieve a wet tensile strength of 1000 grams/inch.

When Polymer B was applied from a solution at pH 9.5, much lower tensile strength values were obtained even at 2.5 percent binder at which a value of about 850 grams/inch was obtained.

The effect is further illustrated in the following Table III wherein samples using Polymer B applied at different binder levels and at different pH values were tested for wet tensile strength.

TABLE III

| % Binder | Wet Tensile Strength Application at pH 5.9 | Wet Tensile Strength Application at pH 9.5 |
|---|---|---|
| 1.5 | 825 | 600 |
| 2.0 | 1200 | 725 |

What is claimed is:

1. A non-woven flexible web having enhanced wet strength and easy disposability, said web comprising a mat of non-woven fibers impregnated with the acid form of a terpolymer formed by the reaction of an unsaturated monomer controlling the hydrophobicity of the terpolymer an unsaturated carboxylic acid and an alkyl capped polyoxyethylene moiety having an ethylenically unsaturated terminal group and at least about 10 oxyethylene units, the monomers having been reacted in a ratio that said polymer is insoluble below pH 6 and soluble at higher pH values.

2. The web of claim 1 wherein said fibers are cellulosic.

3. The web of claim 2 wherein said mat is paper.

4. The web of claim 1 wherein said polymer is present in an amount of from about 1.5 to about 5 weight percent of the weight of said fibers.

5. A method for treating a non-woven flexible web to enhance its wet strength and disposability wherein said web (1) while in a swollen state is impregnated with an ammonium hydroxide solution or dispersion of a linear terpolymer formed by the reaction of an unsaturated monomer controlling the hydrophobicity of the terpolymer, an ethylenically unsaturated carboxylic acid, and an alkyl capped polyoxyethylene moiety having an ethylenically unsaturated terminal group and at least about 10 oxyethylene units, the monomers being in a ratio that said polymer is water insoluble below pH 6 and soluble above pH 6, (2) is dried and (3) said polymer is converted to its acid form.

6. The method claimed in claim 5 wherein said web is impregnated with an ammonium hydroxide solution of said polymer, the impregnated web dried and subsequently treated with an aqueous solution of an acid stronger than the carboxylic acid of said polymer to generate the acid form of said polymer.

7. The method claimed in claim 6 wherein the treated web is dried prior to exposure to the acid.

8. The method claimed in claim 5 wherein said polymer is a terpolymer of styrene, maleic anhydride and a vinylbenzyl ether of an alkylene oxide adduct of an alkyl phenol.

9. The method claimed in claim 8 wherein said terpolymer is composed of styrene, maleic anhydride and a vinylbenzyl ether of a forty mole ethylene oxide adduct of nonyl phenol.

* * * * *